United States Patent [19]

Wills

[11] Patent Number: 4,648,364

[45] Date of Patent: Mar. 10, 1987

[54] ENGINE PROTECTION APPARATUS

[76] Inventor: William H. Wills, 115 Lakeview Dr., New Port Richey, Fla. 33552

[21] Appl. No.: 752,801

[22] Filed: Jul. 8, 1985

[51] Int. Cl.[4] ..... F02B 77/08

[52] U.S. Cl. ..... 123/198 D; 123/198 DB; 123/198 DC

[58] Field of Search ..... 123/198 D, 198 DB, 198 DC

[56] References Cited

U.S. PATENT DOCUMENTS

| | | | |
|---|---|---|---|
| 4,019,489 | 4/1977 | Cartmill | 123/198 D |
| 4,088,110 | 5/1978 | Sperline | 123/198 DB |
| 4,150,654 | 4/1979 | Heitzman et al. | 123/198 DB |
| 4,212,278 | 7/1980 | Eisinger et al. | 123/198 DB |
| 4,311,124 | 1/1982 | Schülzke | 123/198 DB |
| 4,338,896 | 7/1982 | Papasideris | 123/198 DB |
| 4,475,498 | 10/1984 | Hurner | 123/198 DB |
| 4,542,718 | 9/1985 | Hurner | 123/198 DB |

*Primary Examiner*—Ira S. Lazarus

*Attorney, Agent, or Firm*—Ronald E. Smith; Miguel A. Valdes

[57] ABSTRACT

An engine protection apparatus that monitors several engine functions and that disables the engine in response to the detection of undesireable operating conditions. When ambient temperatures are low, an extended engine warm up period is provided; since the vehicle may be left unattended during an extended warm up period in a cold climate, the engine is monitored during the warm up period so that it may be disabled by the apparatus if an undesireable operating condition arises. Similarly, when ambient temperatures are high, an extended engine cool down period is provided; since the engine may be left unattended during the cool down period, the engine is monitored by the apparatus and disabled if an undesireable operating condition is detected. The apparatus also monitors the engine during its normal operating times, in addition to the warm up and cool down periods of time.

15 Claims, 3 Drawing Figures

ENGINE PROTECTION APPARATUS

BACKGROUND OF THE INVENTION

1. Field of the Invention

This invention relates to engine protection apparatus, and more particularly, to an apparatus that monitors several engine operating conditions, provides an indication on engine malfunction, disables the engine in the event of malfunction and provides monitored engine cooldown and warm up periods.

2. Description of the Prior Art

There are several engine protection apparatus known to the art. U.S. Pat. No. 4,136,329, issued Jan. 23, 1979 to Trobert, discloses an apparatus that shuts down an engine responsive to adverse engine operating conditions. However, the Trobert apparatus does not provide automatic warming up and cooling down periods.

Other engine protection devices are disclosed in U.S. Pat. No. 3,568,648, issued Mar. 9, 1971, to Cass; U.S. Pat. No. 4,019,489, issued Apr. 26, 1977, to Cartmill; U.S. Pat. No. 4,147,151, issued Apr. 3, 1979, to Wright; and U.S. Pat. No. 4,106,470, issued Aug. 15, 1978, to San Sebastian Saizar.

It is known that engines operate more efficiently when they are warm, and that abrupt shut down of a hot engine is undesireable. Accordingly, a warm up period is indicated, especially when ambient temperatures are low, and a cool down period is indicated, especially whem ambient temperatures are high and the operating temperature of the engine is high. However, the driver of a vehicle may not have the patience or inclination to remain with the vehicle during its warming up or cooling off period. Thus, if the engine develops a problem while it is operating and unattended, no one will be present to observe or hear the warning lights or buzzers with which the vehicle may be equipped, and to shut down the engine as needed. Accordingly, an engine monitoring apparatus specifically configured to provide a warm up and cool down period and to monitor the engine during such times, as well as at all other times, and to shut down the engine if trouble develops, would represent an advance in the art.

There is a present need for engine protection apparatus that protects engines by providing monitored warming up periods when the engine is cool, e.g. in the morning, and by providing monitored cooling down periods.

It is, accordingly, a general object of this invention to provide an apparatus that can monitor several engine operating conditions.

Another object of this invention is to provide an apparatus that can indicate an engine malfunction by means of an audible or visible signal.

Another object of this invention is to provide an apparatus that can disable an engine in the event of a malfunction.

Still another object of this invention is to provide an apparatus that allows automatic monitored cooling down and warming up periods for engine protection.

SUMMARY OF THE INVENTION

This invention accomplishes these and other objects by providing an apparatus for engine protection comprising a starter circuit, an ignition circuit, a power circuit, a clock circuit, an inhibit circuit, a detection and delay circuit, a shutdown circuit and a warming up and cooling down circuit. The apparatus is able to shutdown an engine in the event of an existing condition that may prove harmful to the engine. The conditions monitored are oil pressure, engine temperature, and coolant level. The apparatus provides a warning period prior to safety shutdown and a delay period on start-up to allow operation of the engine in emergency situations. An additional circuit attached to the apparatus provides a light emitting diode (L.E.D.) readout. This circuit provides a visual indication of the reason for an engine shutdown, an emergency shutdown means and an overriding means.

The apparatus provides several significant features and advantages. The warm up, cool down and override timers are fully automatic. The shutdown system is also automatic. Extra inputs may be provided to monitor up to twenty five (25) functions, other than oil pressure, engine temperature and coolant level. The timers in the apparatus can be set to suit a specific need. A warning buzzer sounds at five (5) seconds prior to shutdown, and if the shutdown condition corrects itself the engine will continue to run. An emergency stop button is provided when the engine is in the warm up or cool down period. The apparatus is self-checked since by turning the ignition on, the alarm buzzer will sound. The sounding of the buzzer indicates that the apparatus is functioning. The apparatus has utility in the environment of gasoline and diesel engines.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description taken in connection with the accompanying drawings, in which.

Similar reference numerals refer to similar parts throughout the several views of the drawings.

DETAILED DESCRIPTION OF THE PREFERRED EMBODIMENT

Figure 1:
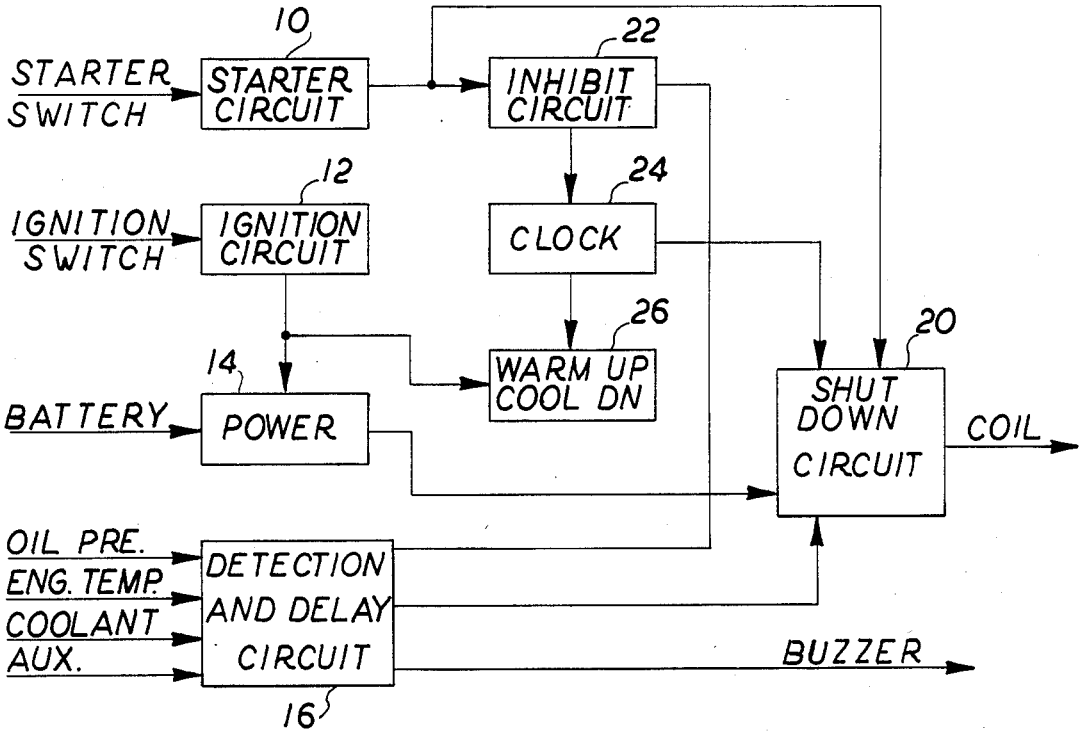
FIG. 1 is a block schematic diagram of an apparatus in accordance with the invention.

The diagram of FIG. 1 shows various inputs to the apparatus circuits. The starter input comes from the engine's starter switch. This input voltage (from 10 to 24 volts D.C.) is present only when the starter is engaged. This input voltage is applied to a starter circuit 10. The ignition input comes from the engine's ignition switch. This input voltage (from 10 to 24 volts D.C.) needs to be present only when the engine is running. While the starter is engaged this input may be absent. This voltage input is applied to an ignition circuit 12. The battery input comes from the voltage source supplying the engine. This input voltage (from 12 to 24 volts D.C.) is present at all times and is applied to a power circuit 14. The ground, which is the voltage source return of the apparatus, is usually provided by the ground lug on the engine block or the return on the battery. An input not shown in FIG. 1 is the immediate shutdown input, which is an override of the normal shutdown sequence. This input comes from an externally connected normally open push button switch.

When the switch is activated, it will immediately shut down the engine without any of the normal operating delays to be discussed later.

There are a number of inputs connected to a detection and delay circuit 16. A sensor to provide an oil pressure input signal is a normally open transducer which closes to ground in the event of low pressure. A sensor already present on the dash board may be used for this purpose. Another sensor to provide an engine temperature input signal is a normally open transducer which closes to ground in the event of an over-temperature condition. A sensor already present on the dash board may be used for this purpose. Another sensor to provide an engine coolant input signal is a special probe to monitor the engine coolant level. This conductive probe monitors the resistivity of the coolant. Others sensors may be attached as auxiliary inputs to the detection and delay circuit 16.

Still referring to FIG. 1, there are several outputs from the circuits of the apparatus. A buzzer output from circuit 16 is an open collector to ground to which a D.C. buzzer is mounted. The mount may be remote or on the enclosure. The buzzer is activated five (5) seconds prior to a shutdown. A coil output is connected to the coil of the ignition system. This output comes from the normally open contacts of a relay on a shutdown circuit 20 of the apparatus. Other outputs are connected to a display circuit 18 illustrated in FIG. 3 and discussed later. A power and ground output supplies voltage to operate the display. The power is supplied while the ignition switch is energized and the ground is continually supplied. The oil pressure, engine temperature, coolant level and auxiliary detectors have an output to circuit 18. Circuit 18 uses these signals to identify which of the monitored parameters shut the engine down. An output signal of the aforesaid immediate shutdown operation is also sent to circuit 18.

Figure 2:
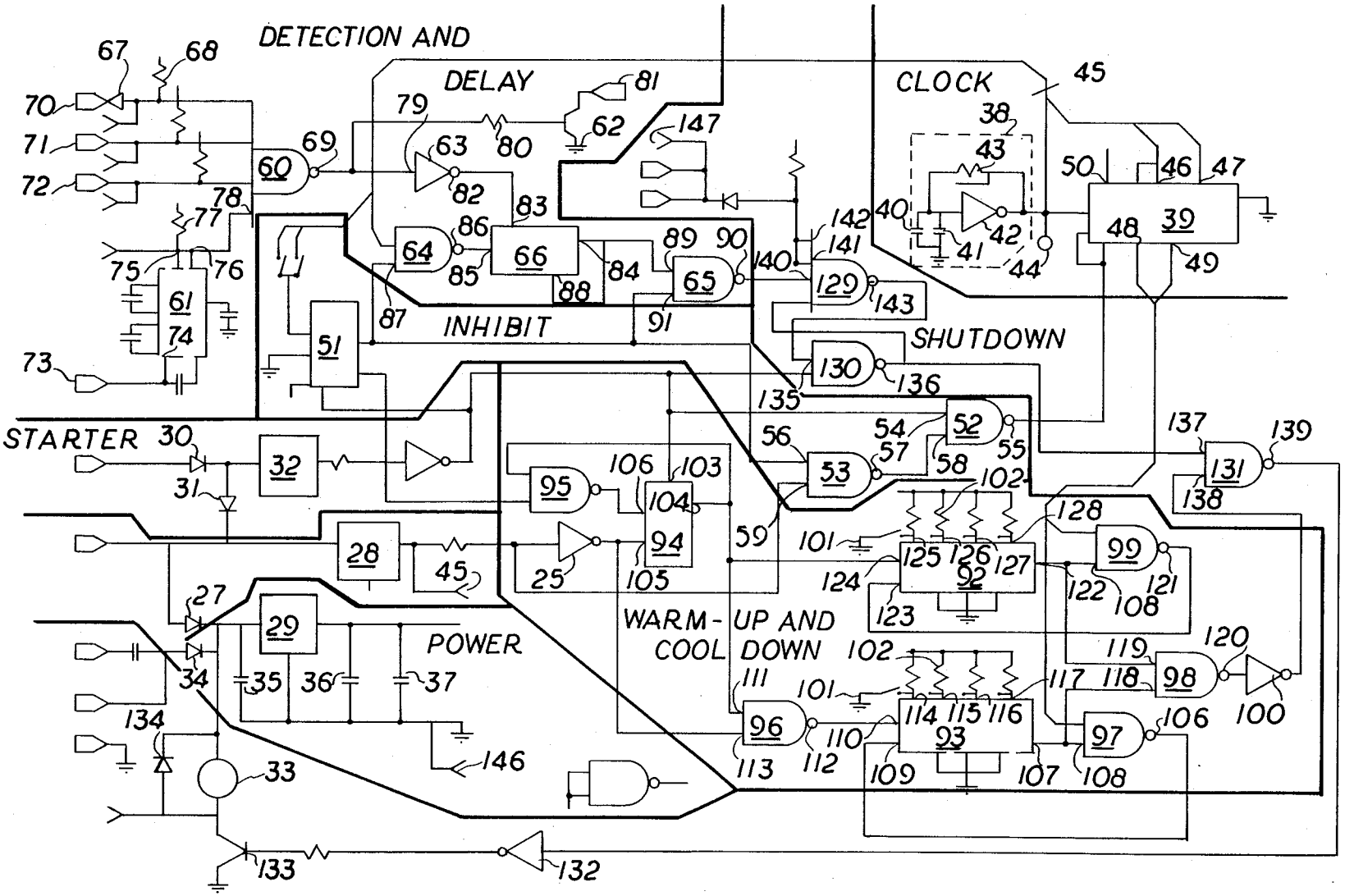
FIG. 2 shows the basic electrical circuit of the apparatus in accordance with the invention.

Other circuits of the apparatus, as shown in FIG. 1, include an inhibit circuit 22, a clock circuit 242 and a warm-up and cool-down circuit 26. These circuits will be discussed later in detail. The preferred embodiment electrical circuit shown in FIG. 2 is subdivided into the aforesaid circuits for the purpose of the discussion that follows.

The ignition circuit 12 comprises a diode 27 and a voltage regulator 28, which is a 7812 three pin regulator. Voltage, supplied from the ignition switch, is applied to regulator 28 so as to insure that the voltage remains within the operating range of the integrated circuits used in the embodiment. The output of regulator 28 is used to detect the closure of the ignition switch. The voltage from the ignition switch which passes through diode 27 goes also to a voltage regulator 29 (also a 7812 three pin regulator), which supplies power to the entire apparatus. The starter circuit 12 comprises diodes 30 and 31 and a voltage regulator 32 (also a 7812 three pin regulator). Voltage supplied from the energized starter switch passes through diode 30 to the regulator 32 to insure that the voltage remains within the operating range of the integrated circuits used in the embodiment. The output of regulator 32 is used to detect the closure of the starter switch. The voltage from diode 30 also passes through diode 31 to be used in engines that disengage the ignition when the starter is engaged. This insures the presence of voltage in the ignition circuit when the starter is engaged. Diodes 30 and 31 are installed in such a way as to allow current to flow from the starter to the ignition and block any current flow from the ignition to the starter.

The power circuit 14 in this embodiment comprises the voltage regulator 29. Voltage is applied to regulator 29 from three different sources. When the starter is energized voltage passes through diodes 30 and 31 to the input of regulator 29. When the ignition is energized voltage passes through diode 27 to the input of regulator 29. Whenever the contacts of a control relay 33 close, the battery will energize an engine coil and apply voltage through a diode 34 to the input of regulator 29. Diodes are placed on all these possible inputs to prevent any voltage feed back into the other circuits. A capacitor 35 (0.33 microfarads) is electrically connected to the input of regulator 29 to filter the input voltage. A capacitor 36 (470 microfarads) and a decoupling capacitor 37 (0.01 microfarads) are also connected to regulator 29.

Clock circuit 24 generates the time base for all the timed functions of the system. Circuit 24 comprises an oscillator 38 and a binary counter 39. The oscillator 38 comprises capacitor 40 (0.01 microfarads) and capacitor 41 (10 microfarads) connected to inverter 42 with a potentiometer 43 used as a feedback resistor. Circuit 24 generates a clock with the frequency varied according to the setting of potentiometer 43, The frequency at a test point 44 is approximately one hertz (1 cps). This frequency will be referred to later as the one (1) second clock. This one hertz signal is the input to the binary counter 39, which divides the signal down to other frequencies used by the embodiment circuit. Binary counter 39 is a dual counter connected together to divide the input signal by 256 seconds. There are intermediate taps in counter 39 at pin 45 (2 seconds), at pin 46 (16 seconds), at pin 47 (32 seconds), at pin 48 (64 seconds), at pin 48 (128 seconds) and at pin 49 (256 seconds). Counter 39 is held constantly enabled by pin 50 attached to the power supply at power circuit 14. Counter 39 is held reset by the ignition being engaged or not reset by the inhibit circuit 12, to be discussed later. In short, counter 39 will be reset if the starter is energized or the ignition is energized and the inhibit circuit has timed out.

The inhibit circuit 22 stops the shutdown process during start-up and allows the binary counter 39 to operate during the inhibit time. Circuit 22 comprises a flip-flop 51 and NAND-gates 52 and 53. The flip-flop 51 is held in a set state (Q-output high) as long as the starter is engaged. The start signal also goes to pin 54 of NAND-gate 52 which forces the output, pin 55 of nand-gate 52, to a high state. This holds the binary counter 39 in a reset position so that clock pulses do not get to the clock input of flip-flop 51. With flip-flop 51 held in the set state the Q-not output is low to the input pin 56 of NAND-gate 53. This causes the output pin 57 to be high. When the starter is disengaged, the input to pin 54 of NAND-gate 52 goes high. Since pin 58 is high because of pin 57 of NAND-gate 53, the output of pin 55 goes low allowing the counter 39 to count. When counter 39 reaches a count of 16 (optional 32) the rising edge of this signal clocks the inhibit flip-flop 51 and the Q-output goes low (Q-not goes high). The input to pin 56 is now high and if the ignition is still engaged the output of pin 57 will be low. The input on pin 58 forces the output of pin 55 to go high holding the binary counter reset again. During normal operation the binary counter 39 will remain reset until the ignition is disengaged which will take pin 59 low forcing the output of pin 57 (input of pin 58) to go high. This forces the output of pin 55 to go low at which time the counter 39 will start counting for the warm-up or cool-down cycle.

The detection and delay circuit 16 detects a closure to ground of the attached transducers and passes a fault condition to the remaining circuit. Circuit 16 comprises a four-input NAND-gate 60, a liquid level detector 61, a transistor 62, an inverter 63, a two-input NAND-gate 64, a two-input NAND-gate 65, a decay counter 66 and various resistors and capacitors. An oil pressure sensor is connected through a diode 67 to a pull-up resistor 68 and to the input of NAND-gate 60. When a shutdown condition exists, the oil pressure sensor provides a path to ground through the diode 67 taking the input of NAND-gate 60 to ground. This forces the output of NAND-gate 60 at pin 69 to go high. The oil pressure, engine temperature and auxiliary signals received at terminals 70, 71 and 72, respectively, follow the same path into the circuit 16. The coolant level signal received at terminal 73 comes into pin 74 of detector 61, which senses the resistance of the liquid. If everything is all right, pins 75 and 76 will be pulled high through the pull-up resistor 77. If detector 61 senses low level coolant, the output pins 75 and 76 will be pulled to ground. The output at pin 76 is connected to pin 78 of the NAND-gate 60 and, as in other sensors, a low level on the input at pin 78 causes the output at pin 69 to go high. Pin 69 is connected to inverter 63 at pin 79. This output is used for the shutdown delay and as input to resistor 80 on the base of transistor 62, which controls the buzzer at terminal 81. As long as no shutdown condition is present (pin 69 low), transistor 62 will not conduct. When a shutdown is present (pin 69 high), transistor 62 will conduct because of the forward bias on the base collector junction of transistor 62, which provides a path to ground for the buzzer (connected externally). The output of inverter 63 at pin 82 is connected to a reset pin 83 of the counter 66. As long as no shutdown condition is present, pin 83 will be held high and the output pin 84 will remain low. A shutdown condition will change pin 83 to low, allowing counter 66 to operate. The clock input to counter 66 is pin 85, which is connected to the output pin 86 of NAND-gate 64. NAND-gate 64 gates the one second clock from inverter 63 to the counter only after the inhibit delay time has passed. During the start-up the inhibit input at pin 87 (nand-gate 64) is low, forcing the output at pin 86 to remain high. After the inhibit time, the inhibit input at pin 87 is high, allowing the one second clock to pass through. When a shutdown signal comes through and allows the counter 66 to operate it will count to five (5) and the output pin 84 will go high. This is a feedback to the enable input at pin 88 that stops the counter 66 from progressing. The signal from pin 84 next goes to the input at pin 89 of NAND-gate 65. As long as no shutdown is present the input at pin 89 is low forcing the output at pin 90 of NAND-gate 65 to be high. If there is a shutdown present, after the counter 66 counts to five (5), pin 89 will be high and the inhibit input (pin 91 of NAND-gate 65) will also be high forcing the output at pin 90 to go low. This low signal is transferred to the shutdown circuit 20.

The warm-up/cool-down circuit 26 energizes the coil to keep the engine running while the timers in circuit 26 count their preset times. The warm-up section of circuit 26 is engaged by turning off the ignition switch within the inhibit time discussed earlier. If the ignition switch is left on over the time limit of the inhibit time, the cool-down timer will be engaged when the ignition switch is disengaged. Circuit 26 comprises binary counters 92 and 93, a flip-flop 94, NAND-gates 95,96,97,98 and 99, inverters 100 and 25, eight switches 101 and eight resistors 102. The clear input at pin 103 of flip-flop 94 is held low as long as the starter is engaged. This sets the Q-not output (pin 104 of flip-flop 94) to high. The input at pin 105 of flip-flop 94 is the inverted ignition signal from inverter 25. While the ignition is engaged this signal will be low. When the ignition is disengaged it will go high. The clock input is controlled by the inhibit circuit 22 discussed earlier. After the starter has been disengaged the output at pin 104 will be determined by the state of the ignition switch when the inhibit times out. The inhibit timing out will cause the clock input at pin 106 of flip-flop 94 to go high clocking in the level at pin 105. If the ignition switch is engaged, the output at pin 104 will remain in the high state selecting the cool-down timer. If the ignition switch is disengaged, the output at pin 104 will go low selecting the warm-up timer. The binary counter 93 is the cool-down timer, which is configured to count down. The clock input comes from the output of NAND-gate 97, pin 106. The inputs to NAND-gate 97 are the carry out from counter 93, pin 107, and the sixty four (64) second timer from counter 39, pin 48. The carry out on NAND-gate 97 at pin 108 will be high until the counter 93 counts down to zero. This allows the sixty four (64) second clock pulses through to the clock input of counter 93, pin 109. The parallel enable input to the counter 93, pin 110, is held high until the ignition has been turned off and the cool-down time has been selected. This is accomplished with NAND-gate 99. The cool down timer is selected when NAND-gate 96, pin 111, is high as aforesaid. The output of NAND-gate 96, pin 112, will remain high until the ignition is disengaged allowing the signal on NAND-gate 96, pin 113, to go high, forcing the output of NAND-gate 96, pin 112, to go low. The counter 93 up to this time has been held in a preset mode loading the preset count on pins 114, 115, 116 and 117. Counter 93 is now allowed to start counting down from this count. When the count reaches zero, the carry out pin 107 will go low disabling the clock input to its counter. This signal also goes to the input of NAND-gate 98, pin 118. At this point, NAND-gate 98, pin 119 is high, so that the low on pin 118 forces the output of NAND-gate 98, pin 120 to go high. This signal goes through the inverter 100 to the shutdown circuit 20 which will shut down the voltage to the engine's coil. The warm-up timer 92 is designed to count down. The clock input for timer 92 comes from the output of NAND-gate 99, pin 121. The inputs to NAND-gate 99 are the carry out from counter 92, pin 122 and the 256 seconds timer from counter 39, pin 49. The carry out at pin 108 will be high until the counter 92 counts down to zero. This allows the two hundred fifty six (256) seconds clock pulses through to the clock input of counter 92, pin 123. The parallel enable input to the counter 92, pin 124, is held high until the inhibit time has passed. At that time, if the ignition had been turned off, counter 92, pin 124, will be low and the warm-up timer will be allowed to operate. The counter 92 up to this time has been held in a preset mode loading the preset count on pins 125, 126, 127 and 128. Counter 92 is now allowed to start counting down from this count. When the count reaches zero, the carry out pin 122 will go low disabling the clock for its input by forcing the output pin 121 go high. The carry out pin 122 also goes to nand gate 98, pin 119. This input going low forces the output pin 120 to go high. This signal goes through inverter 100 to shutdown circuit 20 to drop the voltage to the engine's coil. The eight (8) switches 101 are used to set the times for cool-down and warm-up functions. The switches are split up by four (4) to each function. Switches 101 represent a binary count to the preset inputs on the four thousand five hundred sixteen (4516) seconds (counter 92 and 93). The cool down will be in increments of sixty four (64) seconds (cool down clock is the sixty four (64) second clock) and the warm up will be in increments of two hundred fifty six (256) seconds (warm-up clock is the two hundred fifty six (256) second clock).

The shutdown circuit 20 interprets the various reasons for shutting down and controlling relay 33, which delivers the voltage to the engine's coil allowing it to run. Circuit 20 comprises a four-input NAND-gate 129, a two-input NAND-gate 130, a two-input NAND-gate 131, an inverter 132, a transistor 133, the relay 33 and a diode 134. NAND-gates 129 and 130 form a R-S flip-flop. When the starter is engaged, NAND-gate 130, pin 135, will be low forcing the output pin 136 to be high. This high level is passed to NAND-gate 131, pin 137. The other input of NAND-gate 131 (pin 138) will be high because the cool-down and warm-up timers will be disabled. NAND-gate 131, pin 139 will then be low. This signal goes through inverter 132 (inverted to a high) and drives the base of transistor 133. Transistor 133 is then allowed to conduct current through the coil closing the normally open contacts of relay 33 to supply voltage to the engine's coil thereby allowing the engine to run. Then the starter can be disengaged and the relay 33 will remain energized as long as no shutdown condition exists. A safety shutdown will reach circuit 20 on pin 140 of NAND-gate 129. Safe conditions will have a high level and shutdown conditions will have a low level on pin 140. A shutdown can also be generated by taking the immediate shutdown input to ground at pins 141 and 142 of NAND-gate 129. A low on any of these pins (pins 140, 141 and 142) will cause the output pin 143 of NAND-gate 129 to go high. This is the input to NAND-gate 130 at pin 144. Assuming that the starter is disengaged and the NAND-gate 130, pin 135 is high, then the output pin 136 will go low. This low signal goes to the input at pin 137. This forces a high output on pin 139 which goes through inverter 132 dropping the coil of relay 33. Then the relay contacts open and drops the voltage to the engine's coil. The diode 134 is placed around the coil of relay 33 to short out the inductive effect when turning the relay 33 off.

The other way to generate a shutdown is for the warm-up or cool-down timers to time out. This condition presents a low level to circuit 20 at pin 138. This low signal forces the output pin 139 to be high. The high signal goes through inverter 132 and drops the relay 33 out.

Figure 3:
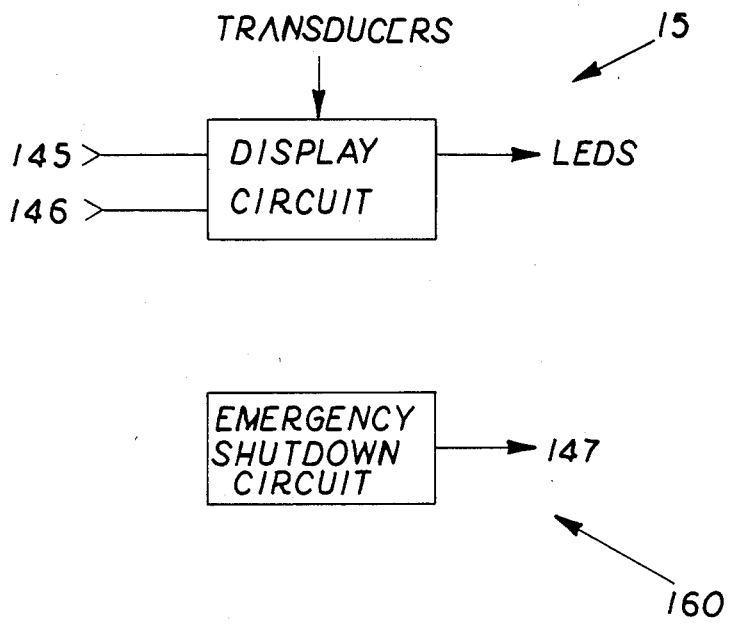
FIG. 3 shows a standard display circuit.

Referring to FIG. 3, the embodiment shown therein includes a standard display circuit 150 that provides a visual indication of the reason for an engine shutdown detected by the invention. It also includes an optional emergency shutdown circuit 160 to override the functions of the invention. The standard circuit comprises four L.E.D.s, four resistors and a normally open switch. Power is supplied to the standard circuit via pin 145 of the ribbon connector and pin 146 serves as the ground. The four L.E.D.s receive power on the anode side. The cathodes are electrically connected to resistors in the standard circuit which are pulled to ground through the transducers attached to the invention. When the transducers go to ground, the L.E.D. attached to that transducer is activated, thereby indicating the shutdown. An emergency stop switch, used for an emergency shutdown, is connected to ground on one side of the normally open switch. The other side of the normally open switch is connected to pin 147 of the ribbon cable connector. When the open switch is depressed, the ground passes through to the circuit of the invention shutting down the engine.

The optional circuit comprises three diodes, a relay and a resistor. When this circuit is attached to the invention, the emergency stop switch serves a dual purpose. If the ignition is off, the emergency stop switch will turn the engine off when depressed. If the ignition is on when the emergency switch is depressed, the override option is engaged. Depressing the switch with the ignition on energizes the relay and closes the normally open contacts that hold the relay energized when the switch opens. The relay will now remain energized until the ignition is turned off thereby removing the voltage from the relay.

It will thus be seen that the objects set forth above, and those made apparent from the foregoing description, are efficiently attained and since certain changes may be made in the above construction without departing from the scope of the invention, it is intended that all matters contained in the foregoing desription or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An engine protection apparatus, comprising:

monitoring means for monitoring a plurality of operating conditions of the engine;

indication providing means associated with said monitoring means for providing an indication of engine malfunction;

engine disabling means associated with said monitoring means and said indication providing means for disabling the engine in the event of malfunction and after engine cool down and warm up periods;

time generating means for generating a time base for all timed functions of the apparatus;

inhibiting means associated with said engine disabling means and said time generating means for inhibiting the engine disabling operation during engine start up periods;

starter switch closure detecting means associated with said inhibiting means for detecting the closure of the starter switch of the engine;

ignition switch closure detecting means associated with said inhibiting means for detecting the closure of the ignition switch;

means associated with said starter switch closure detecting means, said ignition switch closure detecting means, said engine disabling means and said time generating means for providing monitored warm up periods for the engine; and means associated with said starter switch closure detecting means, said ignition switch closure detecting means, said engine disabling means and said time generating means for providing monitored cool down periods for the engine.

2. An engine protection apparatus according to claim 1 wherein said monitoring means comprises:

means for detecting the oil pressure of the engine;

means for detecting the temperature of the engine;

means for detecting the coolant level of the engine; and means coupled with said oil, engine and coolant level detecting means for providing an adverse condition signal to said engine disabling means when an engine operation condition is adverse.

3. An engine protection apparatus according to claim 1 wherein said indication providing means comprises:

a light emitting means to provide a visual readout of the reason for an engine shutdown; and a buzzing means to provide an audible indication in anticipation of an engine shutdown.

4. An engine protection apparatus according to claim 1 wherein said engine disabling means comprises:

a relay means having normally open contacts that energizes the coil of the ignition system of the engine when the contacts are closed and de-energizes the coil when the contacts return to the open position to thereby disable the engine;

means associated with said monitoring means and said inhibiting means for receiving the adverse condition signal from said monitoring means; and means coupled with said condition receiving means and said cool down and warm up periods providing means for transmitting a signal to the relaying means to disable the engine.

5. An engine protection apparatus according to claim 1 wherein said cool down period providing means comprises:

means for counting down a preset, selectable time for the engine cool down;

means coupled with said ignition detecting means for providing a signal that selects and starts said cool down counting means when the ignition switch is on; and means coupled with said time generating means for providing a signal to open the contact of said relay means and shut down the engine at the end of the cool down preset time.

6. An engine protection apparatus according to claim 1 wherein said warm up period providing means comprises:

means for counting down a preset, selectable time for the engine warm up;

means coupled with the ignition switch in the engine for providing a signal that selects and starts said warm up counting means when the ignition switch is turned off; and means coupled with said time generating means for providing a signal to open the contact of said relay means and to shut down the engine at the end of the warm up preset time.

7. An engine protection apparatus according to claim 1 wherein said time base generating means comprises:

means for generating a clock signal of approximately one hertz; and a binary counter coupled to said clock signal generating means to divide the clock signal into other frequencies to be used by the apparatus.

8. An engine protection apparatus according to claim 1 wherein said inhibiting means comprises:

means coupled with said time generating means to start the time counting of said inhibiting means when the starter is disengaged; and means coupled with said time generating means and said engine disabling means operative to stop the time counting of said inhibiting means and to transmit a signal to the engine disabling means to allow shutdown of the engine while the ignition switch is engaged.

9. An engine protection apparatus according to claim 1 wherein said apparatus further comprises means associated with said engine disabling means and said ignition switch closure detecting means, for overriding the function of said inhibiting means so as to immediately shutdown the engine.

10. An engine protection apparatus according to claim 2 wherein said oil pressure detecting means comprises a normally open transducer means which provides a path to ground in the event of low pressure.

11. An engine protection apparatus according to claim 2 wherein said engine temperature detecting means comprises a normally open transducer means which provides a path to ground in the event of an over-temperature condition.

12. An engine protection apparatus according to claim 2 wherein said coolant level detecting means comprises a conductive probe operative to monitor resistivity of the coolant.

13. An engine protection apparatus according to claim 2 wherein when the starter switch is energized, the engine disabling means is overridden to allow the engine to operate when it is first started, such as when there is no oil pressure present.

14. An engine protection apparatus according to claim 13, wherein the engine disabling means may be overridden to get a vehicle equipped with the same off the road.

15. An engine protection apparatus according to claim 14, wherein the engine disabling means is overridden in the absence of push buttons, reset buttons and the like, and wherein the engine protection apparatus requires no special instructions to permit its operation.

* * * * *